US007111731B2

(12) United States Patent
Pratt et al.

(10) Patent No.: US 7,111,731 B2
(45) Date of Patent: Sep. 26, 2006

(54) POCKET CLOSURE DEVICE

(75) Inventors: Michael James Pratt, Draper, UT (US); Scott Kendrick Warner, Draper, UT (US); Joseph W. Christensen, Cedar Hills, UT (US)

(73) Assignee: Ogio International, Inc., Bluffdale, UT (US)

( * ) Notice: Subject to any disclaimer, the term of this patent is extended or adjusted under 35 U.S.C. 154(b) by 0 days.

(21) Appl. No.: 10/757,744

(22) Filed: Jan. 15, 2004

(65) Prior Publication Data

US 2005/0155882 A1 Jul. 21, 2005

(51) Int. Cl.
*A63B 55/00* (2006.01)
*A45F 3/04* (2006.01)
*A45C 5/06* (2006.01)

(52) U.S. Cl. ..... 206/315.5; 206/315.3; 150/117; 150/900; 190/111; 224/653

(58) Field of Classification Search ..... 150/117, 150/900; 190/106, 111, 900, 107, 110, 112; 206/315.3, 315, 315.5; 224/653, 654; 383/33, 383/43

See application file for complete search history.

(56) References Cited

U.S. PATENT DOCUMENTS 1,683,029 A * 9/1928 Fanger ..... 280/651
1,927,624 A * 9/1933 Appel ..... 150/117
1,980,714 A * 11/1934 Brady ..... 190/109
2,081,085 A * 5/1937 Bowen ..... 150/115
2,084,757 A * 6/1937 Alter ..... 383/34
2,213,821 A * 9/1940 McCurdy ..... 190/111
2,316,328 A * 4/1943 Guenther et al. ..... 190/124
2,320,415 A * 6/1943 Dalloz ..... 383/31
2,453,940 A * 11/1948 Slobotkin ..... 383/43
2,551,780 A * 5/1951 Wood ..... 206/315.3
2,697,465 A * 12/1954 Johnson ..... 383/4
3,116,773 A * 1/1964 Kikas ..... 383/22
3,123,190 A * 3/1964 Lifton ..... 190/108
3,137,374 A * 6/1964 Holtzman ..... 190/110
3,147,788 A * 9/1964 Pinnola ..... 150/110
3,160,186 A * 12/1964 Conley ..... 206/38.1
3,179,301 A * 4/1965 Lucht ..... 222/213
4,067,422 A * 1/1978 Eberle ..... 190/112
4,088,252 A * 5/1978 Grunberger ..... 224/629
4,142,563 A * 3/1979 Ackerfeldt et al. ..... 206/315.5
4,257,463 A * 3/1981 Monaco ..... 150/111
4,310,109 A * 1/1982 Coyle ..... 224/230
4,383,563 A * 5/1983 Kirchhoff, Jr. ..... 206/315.2
4,767,001 A * 8/1988 Kim ..... 206/315.3
4,796,735 A * 1/1989 Horiuchi ..... 190/109
4,840,258 A * 6/1989 Tomikawa et al. ..... 190/102

(Continued)

FOREIGN PATENT DOCUMENTS

EP 0343069 A1 * 11/1989

(Continued)

*Primary Examiner*—Sua A. Weaver
(74) *Attorney, Agent, or Firm*—Kirton & McConkie; Michael F. Krieger

(57) ABSTRACT

A pocket closure device for facilitating retention of and access to items placed in a pocket. Specifically, certain embodiments of the present invention comprise an elongate resilient member disposed along a pocket and attached to a front panel of the pocket and to an outer surface of a bag. The elongate resilient member acts to bias the front panel against the outer surface of the bag such that the panel may be quickly and effectively accessed in a single movement. The biased nature of the front panel of the pocket also enables quick and automatic closure of the pocket to secure pocket contents.

29 Claims, 5 Drawing Sheets

U.S. PATENT DOCUMENTS

| | | | | | |
|---|---|---|---|---|---|
| 4,869,365 | A | | 9/1989 | Perdue et al. | 206/315.5 |
| 4,890,705 | A | * | 1/1990 | Pineda | 190/18 A |
| 4,976,340 | A | * | 12/1990 | Bieber et al. | 190/109 |
| 4,978,044 | A | * | 12/1990 | Silver | 224/601 |
| 5,031,812 | A | * | 7/1991 | Gustine | 224/191 |
| 5,096,059 | A | * | 3/1992 | Henderson | 206/315.5 |
| 5,176,253 | A | | 1/1993 | Perrin et al. | 206/315.5 |
| 5,222,598 | A | | 6/1993 | Yamazoe | 206/315.5 |
| 5,269,410 | A | | 12/1993 | Abregano | 206/315.5 |
| 5,341,928 | A | | 8/1994 | Jones et al. | 206/315.5 |
| 5,348,205 | A | * | 9/1994 | Steurer | 224/627 |
| 5,402,883 | A | | 4/1995 | Shin | 206/315.3 |
| 5,407,112 | A | | 4/1995 | Christodoulou et al. | 224/153 |
| 5,425,452 | A | | 6/1995 | Shanks et al. | 206/315.7 |
| 5,526,907 | A | * | 6/1996 | Trawick et al. | 190/111 |
| 5,560,749 | A | | 10/1996 | Madison et al. | 8/111 |
| 5,623,980 | A | * | 4/1997 | McMahon | 150/150 |
| 5,649,658 | A | * | 7/1997 | Hoffman et al. | 224/576 |
| 5,704,529 | A | * | 1/1998 | Santoro et al. | 224/629 |
| 5,803,333 | A | | 9/1998 | Fawcett | 224/652 |
| 5,839,553 | A | * | 11/1998 | Dorsam | 190/109 |
| 5,899,371 | A | | 5/1999 | Weliver | 224/245 |
| 5,913,456 | A | * | 6/1999 | Dikeman | 222/95 |
| 5,954,170 | A | * | 9/1999 | Chisholm | 190/109 |
| 5,988,379 | A | | 11/1999 | Yearous | 206/315.3 |
| 6,015,072 | A | * | 1/2000 | Young | 224/153 |
| 6,129,254 | A | * | 10/2000 | Yu | 224/575 |
| 6,131,733 | A | | 10/2000 | Ergle et al. | 206/315.1 |
| 6,293,397 | B1 | * | 9/2001 | Chen | 206/315.9 |
| 6,328,191 | B1 | * | 12/2001 | Conley et al. | 224/563 |
| 6,357,586 | B1 | | 3/2002 | Pratt et al. | 206/315.9 |
| 6,375,004 | B1 | * | 4/2002 | Tuerschmann et al. | 206/315.6 |
| 6,478,151 | B1 | | 11/2002 | Schmidt et al. | 206/315.5 |
| 6,604,618 | B1 | * | 8/2003 | Godshaw et al. | 190/107 |
| 2002/0108828 | A1 | * | 8/2002 | Soskin | 190/112 |
| 2003/0146120 | A1 | * | 8/2003 | Chi | 206/315.5 |
| 2003/0192796 | A1 | * | 10/2003 | Clock | |

FOREIGN PATENT DOCUMENTS

| | | | |
|---|---|---|---|
| WO | WO06/01668 | * | 1/1996 |

* cited by examiner

POCKET CLOSURE DEVICE

FIELD OF THE INVENTION

The present invention relates to pocket closure devices for facilitating retention of and access to items placed therein. Particularly, the present invention relates to a pocket closure device on a golf bag pocket for selectively retaining golf accessories.

BACKGROUND

Various bags are known in the art to facilitate the transport of smaller items. These include purses, knapsacks, backpacks, duffel bags, luggage, and specialty bags. A golf bag, for example, has become an indispensable part of any golfer's inventory. Typically, a golf bag includes one or more pockets for storing smaller golf accessories such as balls, tees, golf gloves, ball markers, divot repair tools, rain gear and windbreakers. Each pocket has an opening through which one may place items in and retrieve items from. A zipper normally closes the opening.

A zipper, however, is often undesirable due to the time and effort required to actuate the zipper as needed to effectively retrieve and/or retain an item. As the game of golf requires frequent access to golf accessories contained within golf bag pockets, a zipper is often particularly undesirable as applied to golf bag pockets. Indeed, a pocket having a zipper requires that the zipper be actuated in one direction to retrieve an item from the pocket, and then actuated in the opposite direction to effectively retain any items remaining therein. Similarly, where the retrieved item is replaced in the pocket, the zipper must be first actuated to open the pocket, and again actuated to close the pocket. Thus, for any particular item that must be retrieved from the pocket and later replaced, a user must actuate the associated zipper a total of four times.

In addition, a zipper is prone to mechanical failure. Indeed, the zipper may become deformed from use and wear over time, or may become caught in the surrounding fabric, thus rendering the zipper ineffective at least temporarily. The tendency for mechanical failure is exacerbated where a zipper is implemented around the perimeter of a pocket or where the pocket is irregularly shaped, such that the zipper requires actuation over or around a curve.

Accordingly, what is needed is a pocket closure device that facilitates quick and easy access to items contained within a pocket. What is also needed is a pocket closure device that minimizes a risk of mechanical failure of the device. Further what is needed is a pocket closure device that automatically and effectively secures pocket contents.

Such devices are disclosed and claimed herein.

SUMMARY AND OBJECTS OF THE INVENTION

The present invention is a pocket closure device for facilitating retention of and access to items placed in a pocket. Specifically, certain embodiments of the present invention comprise an elongate resilient member laterally disposed along a pocket and attached to a front panel of the pocket and to an outer surface of a golf bag. The elongate resilient member is operationally connected to the front panel and may be selectively biased to open the pocket in a single movement. In addition, the potential energy harnessed by so biasing the resilient member causes the resilient member to automatically seal the pocket opening when the biasing force is removed.

A handle element may be provided to facilitate biasing the front panel of the pocket, as discussed above, to quickly and easily access its contents. A handle element may be incorporated into the elongate resilient member at an attachment point on the pocket. Alternatively, a handle element may reside independently on the front panel of the pocket.

A grip element may be incorporated into the front panel of the pocket to facilitate leverage and transport of the bag. According to certain embodiments of the present invention, a grip element may comprise a flap coupled to an outer surface of the front panel of a pocket that has dimensions sufficient to accommodate a hand of a user. In this manner, a user may use the grip element to leverage the bag on one end, while using a second hand to support the opposite end of the bag.

A guard element may extend over an opening of the pocket to further protect pocket contents. The guard element may be attached to the pocket itself, or to an outer surface of a golf bag or other item to which the pocket is attached such that the guard element extends over the pocket opening. In selected embodiments, the guard element may be selectively actuated, and may be removable.

Further, a pocket may incorporate drainage apertures to facilitate cleaning, ventilating and/or draining the pocket.

As the present invention provides a mechanical pocket closure device that utilizes principles of potential energy to provide access to and retention of pocket contents, the present invention avoids the problems of the prior art while improving the security and accessibility of pocket contents.

An object of the present invention is to provide a pocket closure device that facilitates quick and easy access to items contained within a pocket.

Another object of the present invention is to provide a pocket closure device that minimizes a risk of mechanical failure of the device.

A further object of the present invention is to provide a pocket closure device that automatically and effectively secures pocket contents.

These and other features and advantages of the present invention will be set forth or will become more fully apparent in the description that follows. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The presently preferred embodiments of the invention will be best understood by reference to the drawings wherein like parts are designated by like numerals throughout.

As used in this specification, the term "pocket" refers to any enclosure, pouch, receptacle or container capable of receiving and retaining at least one item. The term "zipper" refers to a fastener consisting of two rows of metal or plastic teeth on strips of tape and a sliding piece that closes an opening by drawing the teeth together. The term "traditional locking device" refers to any zipper, snap, button, clasp, buckle or any other traditional device known to those in the art by which to secure pocket contents.

Figure 1:
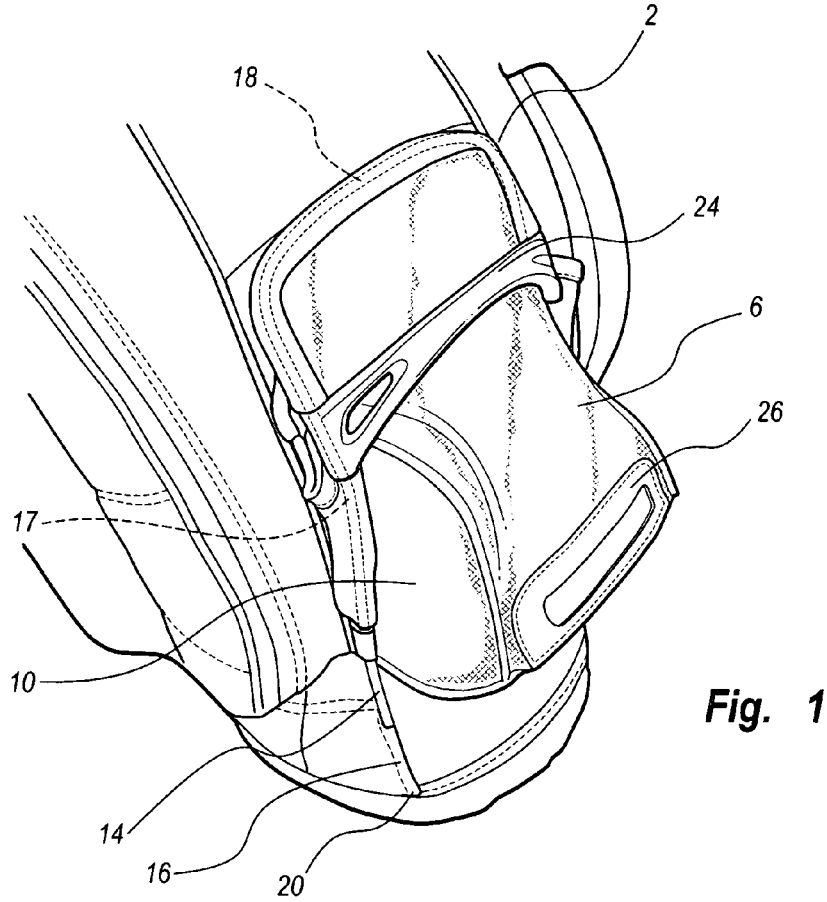
FIG. 1 illustrates a front perspective view of a pocket and pocket closure device in a first closed position in accordance with certain embodiments of the present invention.
Figure 2:
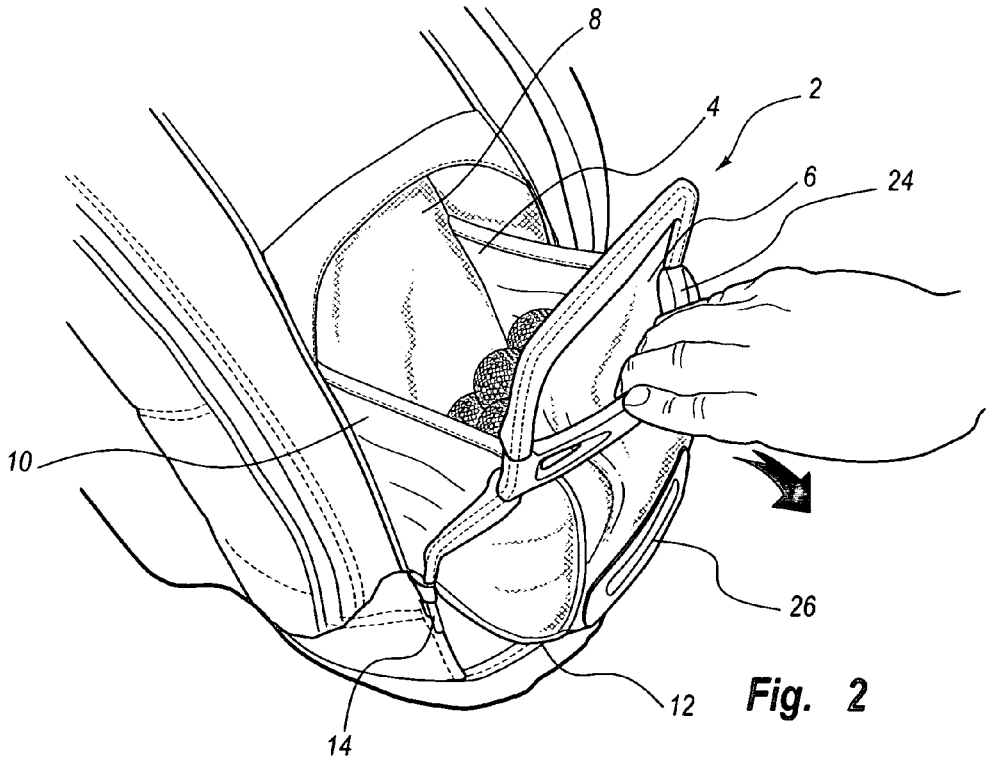
FIG. 2 illustrates a side view of the pocket and pocket closure device of FIG. 1 in a second open position.

Referring now to FIGS. 1 and 2, an enclosure device in accordance with the present invention may comprise a pocket 2 having at least one opening 4. A pocket 2 may comprise a front panel 6, a back panel 8, side panels 10, and a bottom support panel 12. Alternatively, a pocket 2 may comprise simply a front panel 6 that adjoins a back panel 8 to create an enclosed space having an opening 4 at one or more edges. In addition, a back panel 8 may comprise a surface of an item on which the pocket 2 is implemented. A pocket closure device in accordance with the present invention may be implemented in connection with a pocket 2 on a golf bag, a backpack, luggage, or any other bag or item known to those in the art having dimensions sufficient to accommodate the present pocket closure device.

The pocket closure device of the present invention comprises biasing means 14 attached to a front panel 6 of a pocket 2 and to a larger bag or item on which the pocket 2 is implemented. Biasing means 14 may comprise plastic, metal, or any elastomeric or other material known to those in the art capable of being biased to harness potential energy. Biasing means 14 may extend from a first point of attachment 20 beyond a lower edge of the pocket 2 to a second point of attachment on a front panel 6 of the pocket 2.

In one embodiment of the present invention, biasing means 14 comprise an elongate resilient member that is substantially U-shaped. The U-shape is defined by two open ends 16, side portions 17, and an adjoining bridge portion 18 such that the bridge portion 18 may be coupled to the pocket front panel 6 and each open end 16 may be biased against either side of the pocket 2 beyond a lower edge of the pocket 2. In this manner, the resilient member substantially seals the pocket opening 4 in a first closed position automatically, absent application of an opposing force. A user may apply force to re-direct the resilient member away from the back panel 8 of the pocket 2 according to a second open position, such that the user may thereby access the pocket opening 4. Once such force is removed, however, the potential energy effectively harnessed by the resilient member in the second open position causes the resilient member to immediately spring back to the first closed position. In this manner, the enclosure device of the present invention automatically and effectively seals the pocket opening 4 upon access, thereby securing the contents contained therein without requiring a traditional locking device.

According to certain embodiments of the present invention, a handle element 24 may be implemented in connection with the biasing means 14 to facilitate access to pocket contents. A handle element 24 may comprise a finger pull, a cross bar, or any other means known to those in the art by which to facilitate application of an opposing force to biasing means 14. One embodiment of a handle element 24 in accordance with the present invention comprises a cross bar integrally formed with the biasing means 14, such that a user may grip and pull the cross bar to directly effectuate a second open position. As discussed above, the cross bar need only be released to effectively and automatically re-seal the pocket opening 4 in its first closed position.

A pocket 2 may optionally incorporate a grip element 26 to facilitate leverage and transport of an item on which it is implemented. In particular, a grip element 26 may be integrated onto a front panel 6 of a pocket 2 on a bag such that a user may leverage one end of the bag by way of the grip element 26 while supporting a second end of the bag with the other hand. A grip element 26 may comprise a flap coupled to an outer surface of the front panel 6 of a pocket that comprises dimensions sufficient to accommodate a hand of a user. In this manner, a user may insert his hand under the flap to leverage the bag on one end while supporting the other end of the bag with the other hand. Alternatively, a grip element 26 may comprise a cross bar or other mechanical device coupled to the pocket 2 to facilitate leveraging the bag.

Figure 3A:
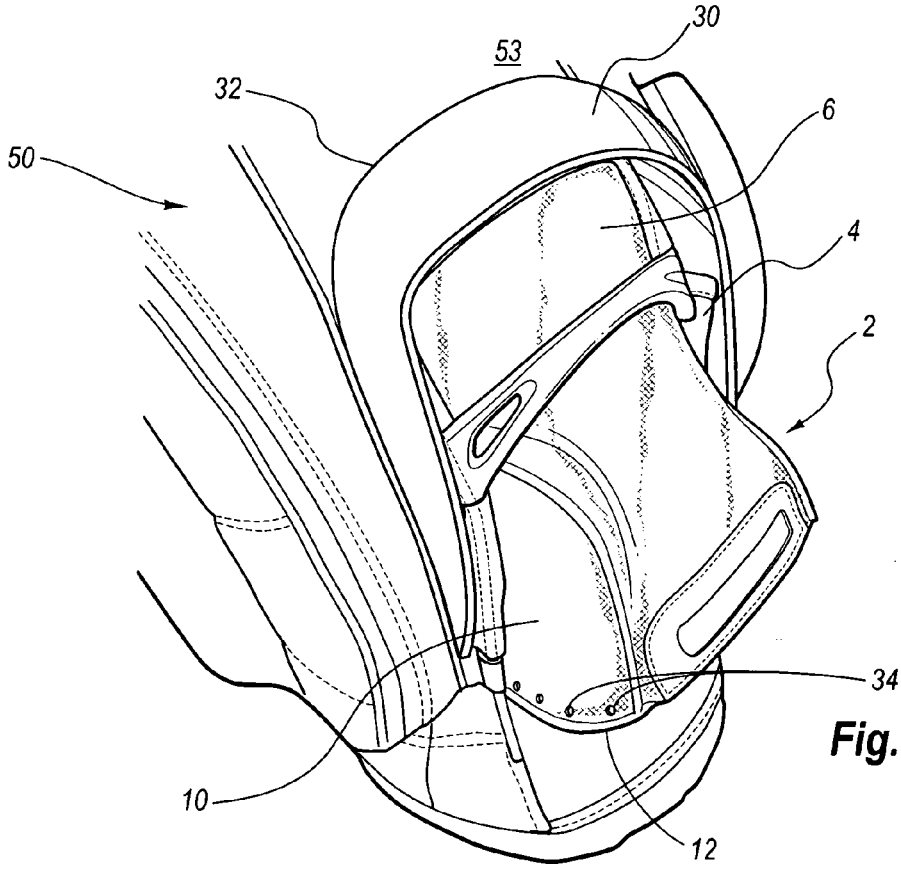
FIG. 3A illustrates a front perspective view of an alternative embodiment of a pocket and pocket closure device in accordance with certain embodiments of the present invention in a first closed position.
Figure 3B:
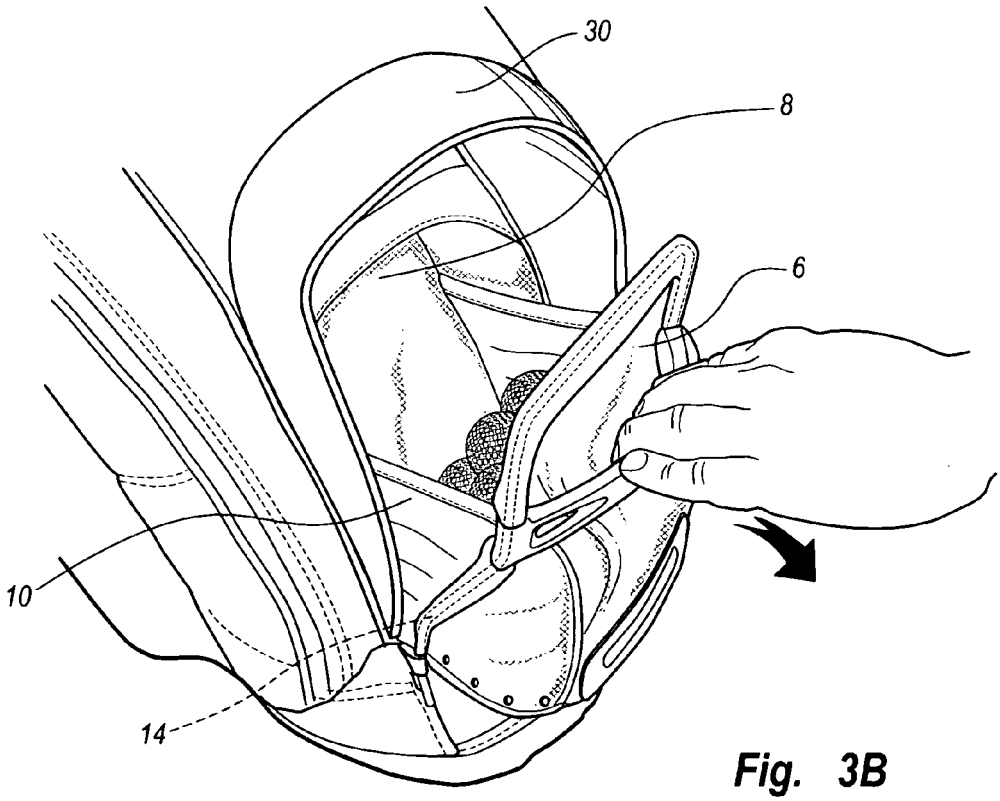
FIG. 3B illustrates a front perspective view of an alternative embodiment of a pocket and pocket closure device in accordance with certain embodiments of the present invention in a second open position.

Referring now to FIG. 3, certain embodiments of the present invention comprise a guard element 30 attached proximate an opening 4 of the pocket 2 to further protect the pocket and its contents. A guard element may comprise a plastic or plastic coated material or any other material known to those in the art capable of repelling or preventing moisture or contaminants from entering an enclosed space defined by pocket 2. A guard element 30 may be integrated into a surface or edge of the pocket 2 such that the guard element 30 may be selectively actuated to substantially cover the pocket opening 4. For example, a guard element 30 may comprise a flap attached to a back panel 8 of the pocket 2, wherein the flap may be selectively positioned to cover any space between the back panel 8 and a front panel 6 of the pocket 2 when the pocket 2 is in a first closed position. Alternatively, a guard element 30 may be integrated into or attached to an outer surface 53 of a bag 50 or other item to which the pocket 2 is attached. In one embodiment, the guard element 30 may comprise a substantially rigid structure to direct moisture or contaminants away from a pocket opening 4. A guard element 30 may further incorporate removable attachment means 32 to render the guard element 30 selectively attachable to either an outer surface 53 of a golf or other bag or to the pocket 2. For example, removable attachment means 32 may comprise a hook and loop material, snaps, rivets, or any other material known to those in the art capable of being selectively and repeatedly implemented.

Embodiments of the present invention may also integrate drainage apertures 34 into at least a portion of a surface area of a pocket 2. Preferably, drainage apertures 34 are incorporated into at least a bottom support panel 12 to facilitate cleaning, ventilation and/or moisture release when the bag on which the pocket 2 is implemented is in a substantially upright position. Drainage apertures 34 may also be implemented in front 6 and side 10 panels of a pocket 2, as well as a back panel 8, where the back pocket panel 8 is independent of an outer surface 53 of a bag on which the pocket 2 is implemented.

Figure 4:
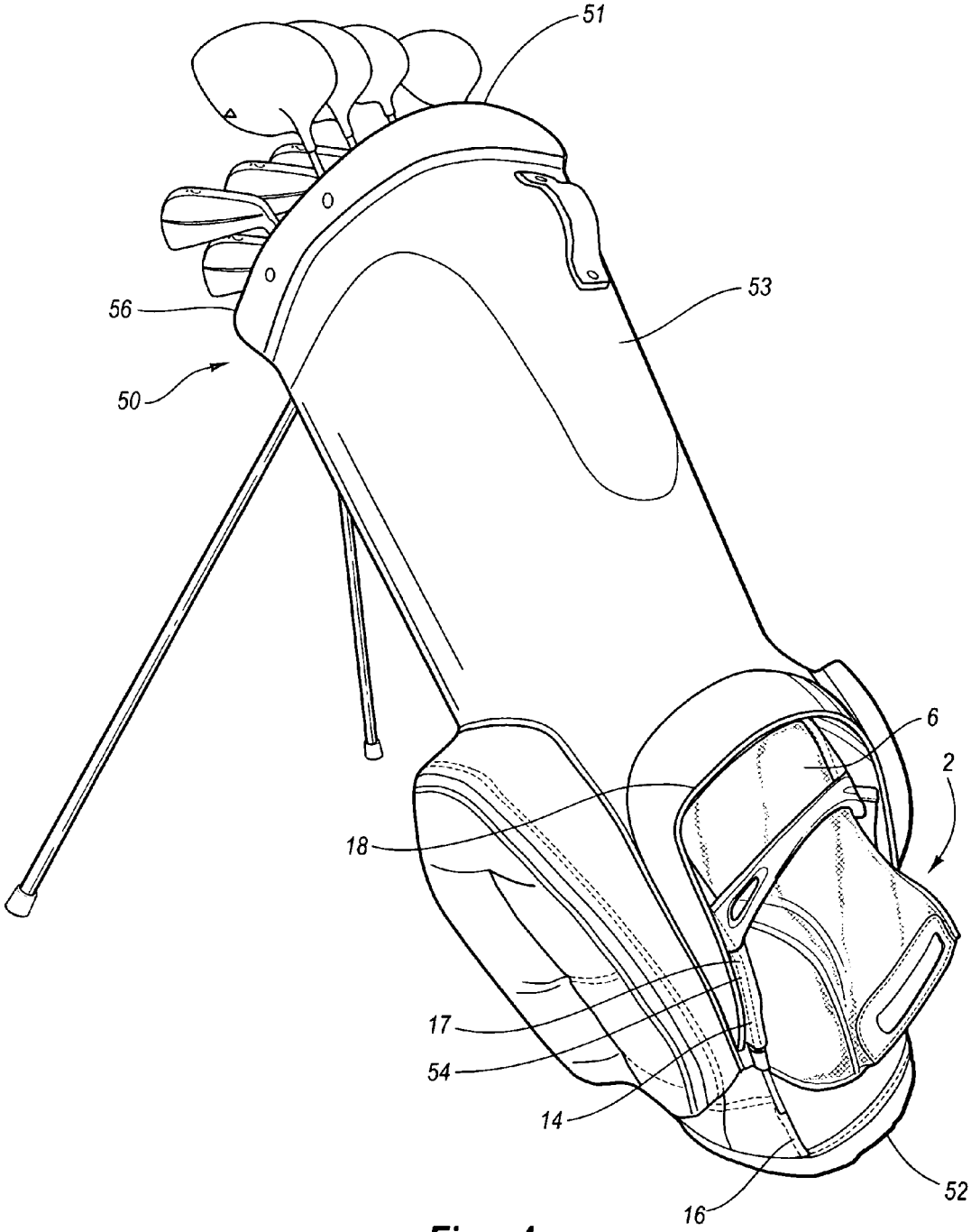
FIG. 4 illustrates a perspective view of a pocket and pocket closure device in accordance with certain embodiments of the present invention implemented in connection with a golf bag.

Referring now to FIG. 4, a pocket closure device in accordance with the present invention may be implemented in connection with a bag 50 having a top end 51, a bottom end 52, an outer surface 53, and a housing 56. A bag 50 may further comprise a shoulder transport assembly to facilitate manual transport of the bag 50. In certain embodiments, the pocket 2 is preferably located proximate a bottom end 52 of the bag 50. Where the pocket 2 is so located, biasing means 14 may be attached to a front panel 6 of the pocket 2 and to an outer surface 53 of the bottom end 52 of the bag 50 substantially beyond the location of the pocket 2. In this manner, the biasing means 14 may seal a pocket opening 4 quickly and effectively without requiring a traditional locking device as the biasing means 14 require deliberate application of force to open the pocket 2.

As discussed above, biasing means 14 may comprise a substantially U-shaped resilient member having two open ends 16, elongate side portions 17, and an adjoining bridge portion 18. According to a presently preferred embodiment of the present invention, each of the two open ends 16 may be secured to an outer surface 53 of the bottom end 52 of the bag 50 such that the side 17 and adjoining bridge portions 18 lie substantially adjacent to a perimeter of the pocket 2. Side portions 17 of the resilient member may be retained substantially adjacent side panels 10 or lateral edges of a pocket 2 by a retaining element 54 affixed thereto. A retaining element 54 may be disposed intermittently or uniformly between the side portions 17 and the side panels 10 or lateral edges of a pocket 2 to retain the side portions 17 in position. Similarly, a retaining element 54 may be implemented along a top edge of the front panel 6 of the pocket 2 to create an operational relationship between the adjoining bridge portion of the resilient member and the front pocket panel 6. A retaining element 54 may comprise an elongated cavity integral to a perimeter of the pocket 2, or any other means known to those in the art by which to retain the side portions 17 substantially adjacent the pocket 2.

Figure 5:
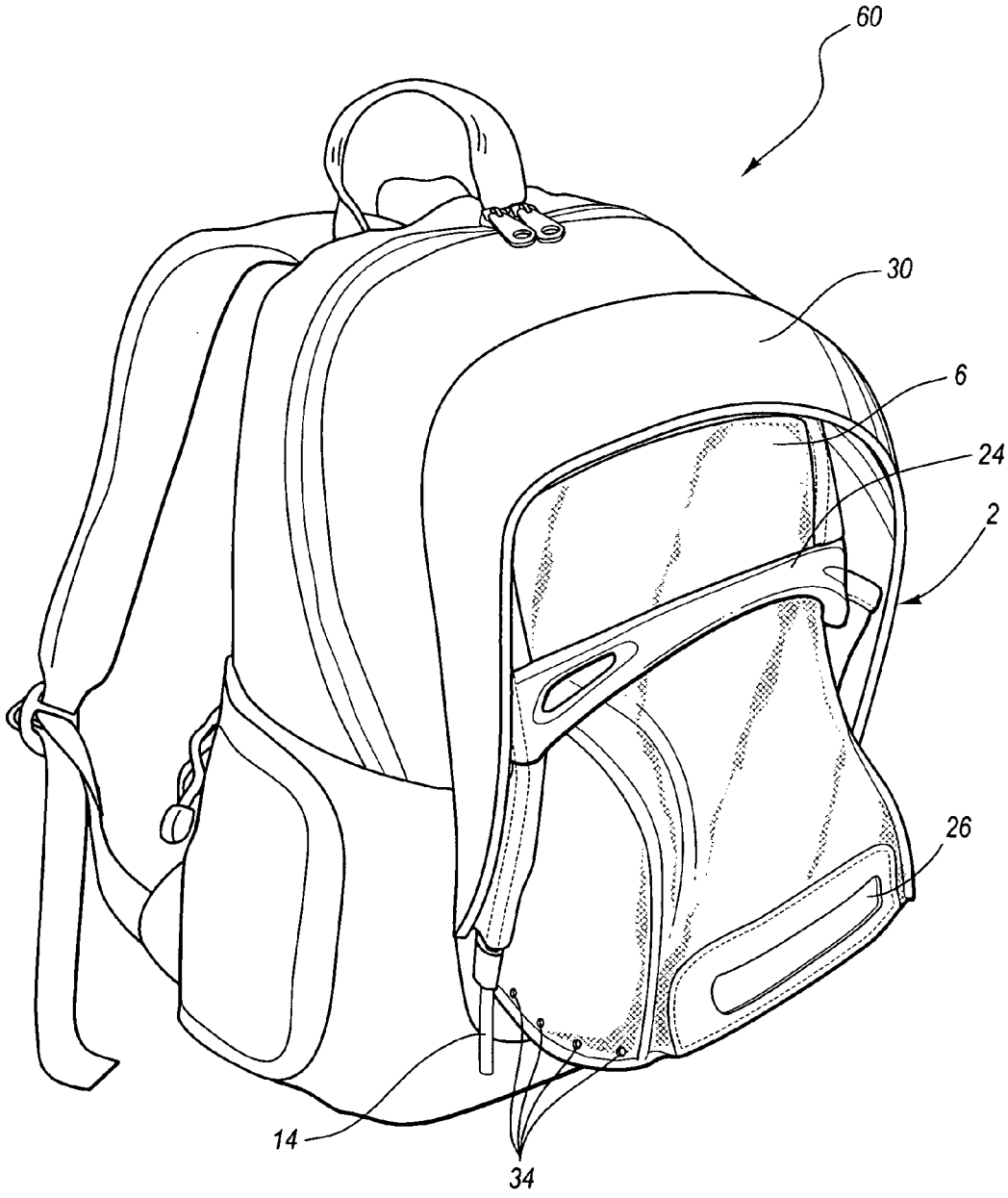
FIG. 5 illustrates a perspective view of a pocket closure device in accordance with certain embodiments of the present invention implemented in connection with a backpack.

Referring now to FIG. 5, the pocket closure device of the present invention may also be implemented in connection with a backpack, luggage or other equipment. According to an embodiment of the present invention implemented in connection with a backpack 60, a first portion of a biasing member 14 may be attached to a front panel 6 of a pocket 2 as discussed above with reference to FIG. 4. A second portion of the biasing member 14 may be attached to a frame of the backpack 60 or other equipment and offset from the pocket 2 to effectuate an automatic effective seal of the pocket opening 4 by harnessing potential energy in the biasing member 14. A pocket closure device in accordance with the embodiment of the present invention depicted in FIG. 5 may also implement any of a guard element 30, a handle element 24, a grip element 26 and/or drainage apertures 34 as discussed above with reference to FIGS. 1–4.

Figure 6:
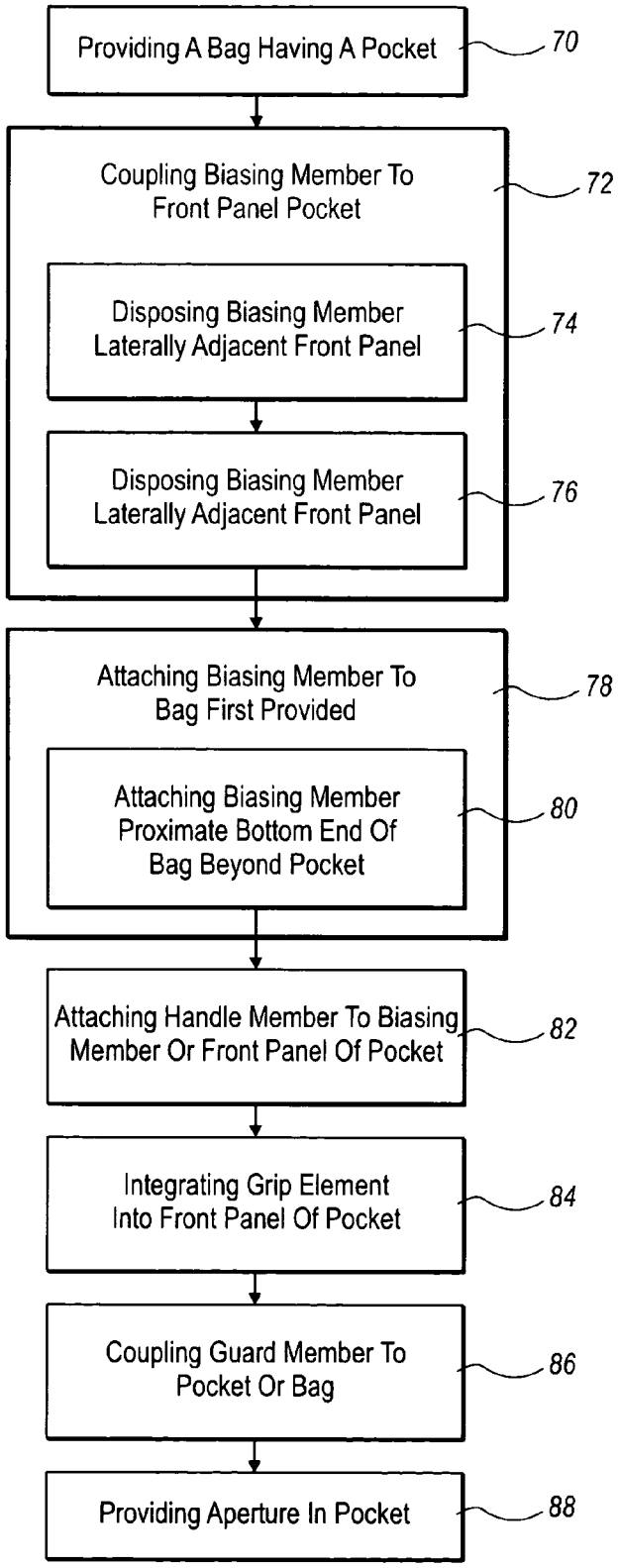
FIG. 6 illustrates a method for facilitating retention of and access to items placed in a bag in accordance with certain embodiments of the present invention.

Referring now to FIG. 6, a method of using a pocket closure device in accordance with the present invention may comprise first providing a bag 70 having a pocket 2 attached to an outer surface thereof. A second step of the method may comprise coupling a first portion of a biasing member to a front panel of the pocket such that the biasing member and the pocket are operationally connected 72. Coupling a biasing member to the front panel 72 may further comprise disposing the biasing member laterally adjacent the front panel 74 and attaching the first portion of the biasing member to an upper portion of the front panel proximate the pocket opening 76.

A third step in accordance with the present method may comprise attaching a second portion of a biasing member to the bag first provided 78. Attaching a second portion of a biasing member to the bag 78 may optionally comprise attaching the second portion of the biasing member proximate a bottom end of the bag substantially beyond the position of the pocket 80 and off center with respect thereto. In this manner the first portion of the biasing member will be at least somewhat out of line with respect to the second portion of the biasing member, thus creating potential energy that causes the biasing member to quickly and effectively seal the opening 4 of the pocket 2 without requiring any externally applied force or traditional locking device.

A fourth optional step of a method in accordance with the present invention may comprise attaching a handle member to either the biasing member or to a front panel of the pocket to facilitate leveraging the pocket to access its contents 82. A fifth optional step of the present method may comprise integrating a grip element into the front panel of the pocket to facilitate leveraging the weight of the equipment or bag to which it is attached for purposes of balance and/or transport 84.

A sixth optional step of a method in accordance with the present invention may comprise coupling a guard member to either of the pocket or an outer surface of the equipment or bag to which it is attached proximate a pocket opening to further safeguard the pocket contents 86. A seventh optional step of the present method may comprise providing at least one aperture in the pocket 2 for the purposes of cleaning, ventilation, and/or drainage 88.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A pocket closure device for a bag, wherein said bag comprises a top end, a bottom end, and an outer surface, said pocket closure device comprising:

a storage receptacle having a front panel, side panels, and an interior space, wherein said storage receptacle is accessible from the exterior of the bag;

a biasing rod having a first end extending from below a pivot axis at the bottom of the front panel and along a perimeter edge of the front panel and a second end of the rod also extending from below the pivot axis and along a second perimeter edge of the front panel; and a pivot point retaining means wherein a counter-force is created when the biasing rod is bent, so as to bias the front panel in a substantially closed position.

2. The pocket closure device of claim 1, wherein said storage receptacle further comprises a grip element coupled to an outer surface of said front panel to facilitate leverage and transport of said bag.

3. The pocket closure device of claim 2, wherein said grip element comprises a flap coupled to said outer surface of said front panel to accommodate a hand of a user.

4. The pocket closure device of claim 1, wherein said biasing rod further comprises a handle element to facilitate leveraging said biasing rod to allow access to said interior space.

5. The pocket closure device of claim 1, wherein said biasing rod further comprises a substantially U-shaped resilient member having two open ends and an adjoining bridge portion, wherein said adjoining bridge portion is coupled to said front panel, and wherein each of said two open ends is coupled to an outer surface of said bag beyond said storage receptacle such that said front panel may be selectively biased with respect to said bag.

6. The pocket closure device of claim 1, wherein said biasing rod comprises material selected from the group consisting of plastic, metal, and an elastomeric compound.

7. A pocket assembly for facilitating retention of and access to accessories placed therein, said pocket assembly comprises:

an accessory pouch having a front, back and sides wherein said accessory pouch is capable of receiving and retaining accessories; and at least one resilient biasing member laterally disposed along and attached to one of said sides of said accessory pouch extending from below said pouch, said at least one resilient member capable of being selectively actuated by simultaneously bearing a tension load and a compression load along its vertical axis to allow access to an interior space defined by said accessory pouch.

8. The pocket assembly of claim 7, wherein said accessory pouch further comprises at least one aperture to facilitate ventilation and moisture release.

9. The pocket assembly of claim 7, wherein said accessory pouch further comprises a grip element coupled to said front of said accessory pouch to facilitate leverage and transport of said accessory pouch of said pocket assembly.

10. The pocket assembly of claim 9, wherein said grip element comprises a flap coupled to said accessory pouch to accommodate a hand of a user.

11. The pocket assembly of claim 7, wherein said accessory pouch further comprises a handle element to facilitate leveraging said at least one resilient member to allow access to said interior space.

12. The pocket assembly of claim 7, wherein said at least one resilient member further comprises a handle element to facilitate leveraging said at least one resilient member to allow access to said interior space.

13. The pocket assembly of claim 7, wherein said at least one resilient member comprises a substantially U-shaped resilient member having two open ends and an adjoining bridge portion, wherein said adjoining bridge portion is coupled to a face of said accessory pouch, and wherein each of said two open ends is coupled to an outer surface of a bag beyond said accessory pouch such that said face of said accessory pouch may be selectively biased with respect to said outer surface of said bag.

14. A bag comprising:

an outer housing for receiving and retaining a plurality of items;

a pocket formed with said outer housing for receiving and retaining at least one accessory, wherein said pocket comprises:

a front panel;

a bottom support panel;

a back panel, wherein said back panel is recessed into said outer housing;

expandable side panels coupled between said front panel and said back panel such that said side panels fold when the front panel is positioned against the bag and expand as said front panel is opened to gain access to the inside of said pocket; and at least one biasing element longitudinally disposed along said front panel and coupled to said outer housing that serves to bias said front panel against said outer housing to automatically seal said pocket.

15. The bag of claim 14, further comprising a guard element attached proximate an opening of said pocket, wherein said guard element extends beyond said opening to protect said at least one accessory retained therein.

16. The bag of claim 15, wherein said guard element is attached to said outer housing.

17. The bag of claim 15, wherein said guard element is attached to said pocket, wherein said guard element may be selectively positioned to substantially cover said opening.

18. The bag of claim 15, wherein said guard element is removably attached to at least one of said outer housing and said pocket.

19. The pocket of claim 14, further comprising apertures within at least one of said front panel, said bottom support panel, and said side panels to permit ventilation and moisture release from said pocket.

20. The bag of claim 14, further comprising a grip element integrated into at least one of said outer housing and said pocket to facilitate leverage and transport of said bag, wherein said grip element comprises a flap having dimensions sufficient to accommodate a grip of a user.

21. The bag of claim 14, wherein said pocket further comprises a handle element to facilitate leveraging said front panel of said pocket to allow access to said at least one accessory.

22. The bag of claim 14, wherein said at least one biasing element of said pocket comprises a substantially U-shaped resilient member having two terminal ends and an adjoining bridge portion, wherein said adjoining bridge portion is integrated into said front panel, and wherein each of said terminal ends is coupled to said housing beyond said bottom support panel of said pocket such that said front panel may be selectively biased with respect to said outer housing.

23. A method for facilitating retention of and access to items in a bag, said method comprising:

providing a bag having a pocket member integrated with said bag with an opening for receiving and retaining at least one item;

coupling to a front panel of said pocket member a first portion of at least one elongate biasing member; and attaching a second portion of said at least one elongate biasing member to said bag, wherein said at least one elongate biasing member is attached to said bag and extends from below a pivot axis up the edge of the front panel and straightens to automatically seal shut said pocket member.

24. The method of claim 23, wherein said coupling to said front panel further comprises disposing said at least one elongate biasing member substantially adjacent said front panel and attaching said first portion of said at least one elongate biasing member to an upper portion of said front panel proximate said opening.

25. The method of claim 24, wherein said attaching a second portion of said at least one elongate biasing member to said bag further comprises attaching said second portion of said at least one elongate biasing member to a bottom end of said bag substantially beyond said pocket member such that said upper portion of said front panel may be selectively biased with respect to said bag.

26. The method of claim 23, further comprising attaching a handle element to said biasing member to facilitate leveraging said pocket member to obtain selective access to an interior of said pocket member.

27. The method of claim 23, further comprising integrating a grip element into said front panel of said pocket member to facilitate leverage and transport of said bag, said grip element having dimensions sufficient to accommodate a grip of a user.

28. The method of claim 23, further comprising coupling to at least one of said bag and said pocket member a guard member proximate said opening to said pocket member, wherein said guard member extends beyond said opening of said pocket member to protect an interior of said pocket member when said pocket member is closed.

29. The method of claim 23, further comprising providing apertures in said pocket member to facilitate at least one of cleaning, ventilating and draining said pocket member.

* * * * *